US011060263B2

(12) United States Patent
Misaki

(10) Patent No.: US 11,060,263 B2
(45) Date of Patent: Jul. 13, 2021

(54) EXCAVATOR AND CONTROL VALVE FOR EXCAVATOR

(71) Applicant: SUMITOMO(S.H.I.) CONSTRUCTION MACHINERY CO., LTD., Tokyo (JP)

(72) Inventor: Youji Misaki, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 204 days.

(21) Appl. No.: 16/135,346

(22) Filed: Sep. 19, 2018

(65) Prior Publication Data

US 2019/0024343 A1 Jan. 24, 2019

Related U.S. Application Data

(63) Continuation of application No. PCT/JP2017/011235, filed on Mar. 21, 2017.

(30) Foreign Application Priority Data

Mar. 22, 2016 (JP) ..... JP2016-057337

(51) Int. Cl.
*E02F 9/22* (2006.01)
*F15B 11/042* (2006.01)
(Continued)

(52) U.S. Cl.
CPC ..... *E02F 9/2267* (2013.01); *E02F 9/2292* (2013.01); *E02F 9/2296* (2013.01);
(Continued)

(58) Field of Classification Search
CPC ..... E02F 9/2267; E02F 9/2292; F15B 11/042; F15B 11/044; F15B 21/14
See application file for complete search history.

(56) References Cited

U.S. PATENT DOCUMENTS 5,622,206 A * 4/1997 Takeuchi ..... E02F 9/2225 137/596
9,903,393 B2 * 2/2018 Wu ..... E02F 9/2282
2009/0056324 A1 3/2009 Itakura et al.

FOREIGN PATENT DOCUMENTS

EP 1536071 6/2005
EP 2899319 7/2015
(Continued)

OTHER PUBLICATIONS

International Search Report for PCT/JP2017/011235 dated Jun. 27, 2017.

*Primary Examiner* — Abiy Teka
(74) *Attorney, Agent, or Firm* — IPUSA, PLLC

(57) ABSTRACT

An excavator includes a lower travelling body; an upper turning body mounted on the lower travelling body; an engine installed in the upper turning body; a hydraulic pump connected to the engine; a hydraulic actuator driven by hydraulic oil discharged by the hydraulic pump to move a work element; a first control valve configured to control a flow rate of the hydraulic oil flowing from the hydraulic pump to the hydraulic actuator; a second control valve configured to control a flow rate of the hydraulic oil flowing from the hydraulic actuator to a hydraulic oil tank; and a control device configured to control opening and closing of the second control valve.

11 Claims, 9 Drawing Sheets

(51) Int. Cl.

| | |
|---|---|
| ***F15B 11/044*** | (2006.01) |
| ***F15B 21/14*** | (2006.01) |
| ***F15B 11/00*** | (2006.01) |

(52) U.S. Cl.
CPC ..... *F15B 11/00* (2013.01); *F15B 11/042* (2013.01); *F15B 11/044* (2013.01); *F15B 21/14* (2013.01); *E02F 9/2217* (2013.01)

(56) References Cited

FOREIGN PATENT DOCUMENTS

| | | |
|---|---|---|
| JP | H04-025001 U | 2/1992 |
| JP | 2002-155907 | 5/2002 |
| JP | 2008-025706 | 2/2008 |
| JP | 2014-074433 | 4/2014 |
| JP | 2014-163072 | 9/2014 |

* cited by examiner

EXCAVATOR AND CONTROL VALVE FOR EXCAVATOR

CROSS-REFERENCE TO RELATED APPLICATION

The present application is a continuation of International Application No. PCT/JP2017/011235 filed on Mar. 21, 2017, which is based on and claims priority to Japanese Patent Application No. 2016-057337, filed on Mar. 22, 2016. The contents of these applications are incorporated herein by reference in their entirety.

BACKGROUND OF THE INVENTION

1. Field of the Invention

The present invention relates to an excavator having a control valve for adjusting the flow rate of hydraulic oil flowing from a hydraulic cylinder to a hydraulic oil tank, and a control valve for the excavator installed in the excavator.

2. Description of the Related Art

An excavator provided with a control valve for adjusting the flow rate of hydraulic oil flowing from a hydraulic cylinder to a hydraulic oil tank is known in the related art.

The control valve has a switchable valve position including an internal flow path for communicating the hydraulic cylinder and the hydraulic oil tank. In the internal flow path, a first diaphragm is formed, so that the operating speed of the hydraulic cylinder can be suppressed.

Furthermore, the excavator of the related art has a switching valve in the return oil line between the control valve and the hydraulic oil tank. The switching valve can switch between a valve position including the internal flow path having a second diaphragm and a valve position including the internal flow path without the second diaphragm.

With this configuration, in the excavator of the related art, the hydraulic oil can flow from the hydraulic cylinder to the hydraulic oil tank through the flow path including the first diaphragm and the second diaphragm connected in series. As a result, it is possible to set the opening area of the first diaphragm to be larger, and compared to a case without the switching valve, the fluid noise when the hydraulic oil passes through the first diaphragm can be reduced.

SUMMARY OF THE INVENTION

According to an embodiment of the present invention, there is provided an excavator including a lower travelling body; an upper turning body mounted on the lower travelling body; an engine installed in the upper turning body; a hydraulic pump connected to the engine; a hydraulic actuator driven by hydraulic oil discharged by the hydraulic pump to move a work element; a first control valve configured to control a flow rate of the hydraulic oil flowing from the hydraulic pump to the hydraulic actuator; a second control valve configured to control a flow rate of the hydraulic oil flowing from the hydraulic actuator to a hydraulic oil tank; and a control device configured to control opening and closing of the second control valve.

DETAILED DESCRIPTION OF THE PREFERRED EMBODIMENTS

In the excavator of the related art, when the hydraulic oil is caused to flow from the hydraulic cylinder to the hydraulic oil tank, the hydraulic oil is passed through the diaphragm, in any case. Therefore, for example, when closing the arm in the air, the closing speed of the arm can be appropriately suppressed; however, in the case of closing the arm for excavation work, unnecessary pressure loss is caused by the diaphragm.

In view of the above, it is desirable to provide an excavator that reduces, when necessary, the pressure loss caused when hydraulic oil is caused to flow from a hydraulic cylinder to a hydraulic oil tank.

Figure 1:
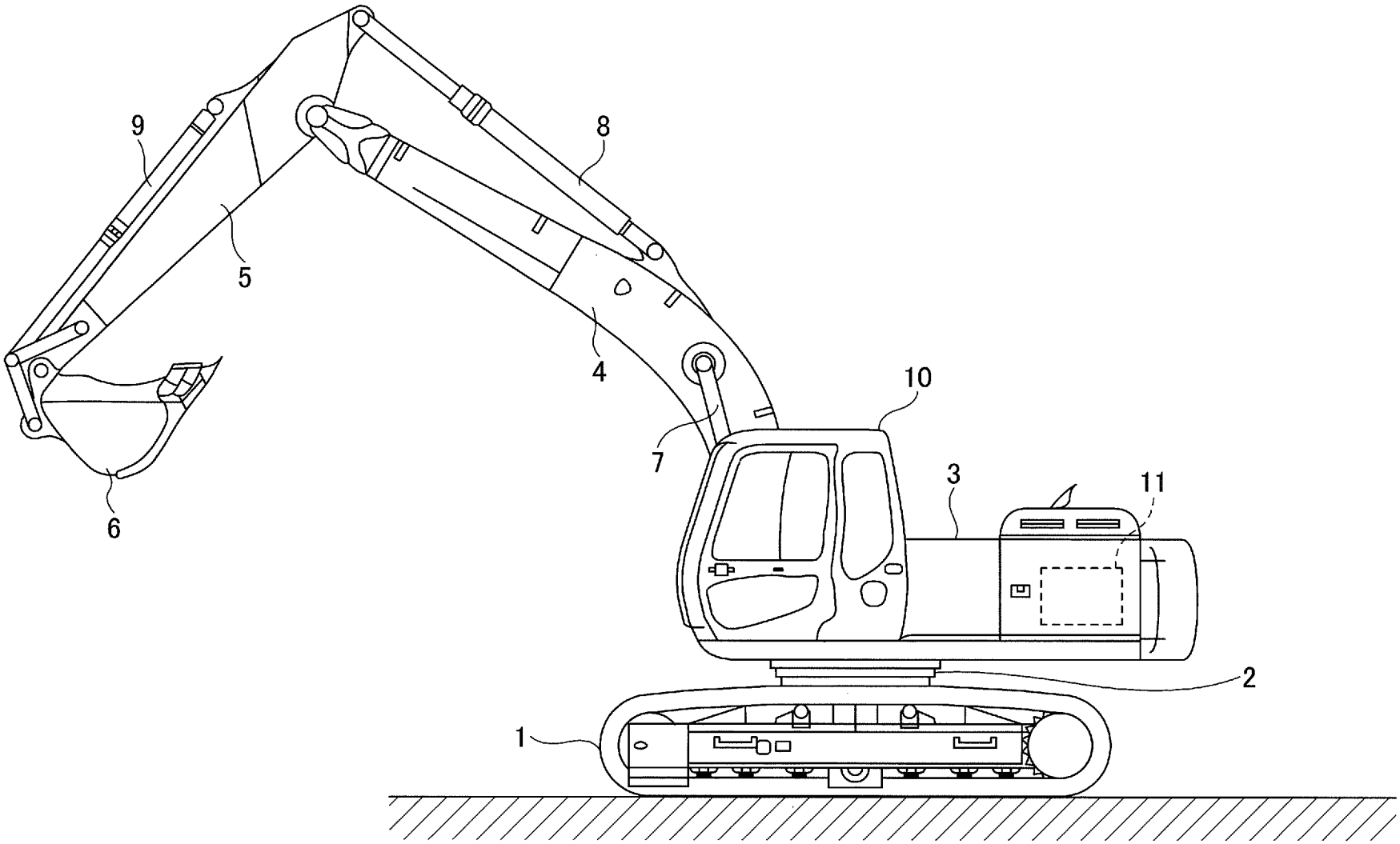
FIG. 1 is a side view of an excavator according to an embodiment of the present invention.

First, with reference to FIG. 1, an excavator that is a construction machine according to an embodiment of the present invention will be described. FIG. 1 is a side view of the excavator. An upper turning body 3 is mounted on a lower travelling body 1 of the excavator illustrated in FIG. 1, via a turning mechanism 2. A boom 4 that is a work element is attached to the upper turning body 3. An arm 5 that is a work element is attached to the tip of the boom 4, and a bucket 6 that is a work element and an end attachment is attached to the tip of the arm 5. The boom 4, the arm 5, and the bucket 6 are hydraulically driven by a boom cylinder 7, an arm cylinder 8, and a bucket cylinder 9, respectively. A cabin 10 is provided on the upper turning body 3 and a power source such as an engine 11 is mounted on the upper turning body 3.

Figure 2:
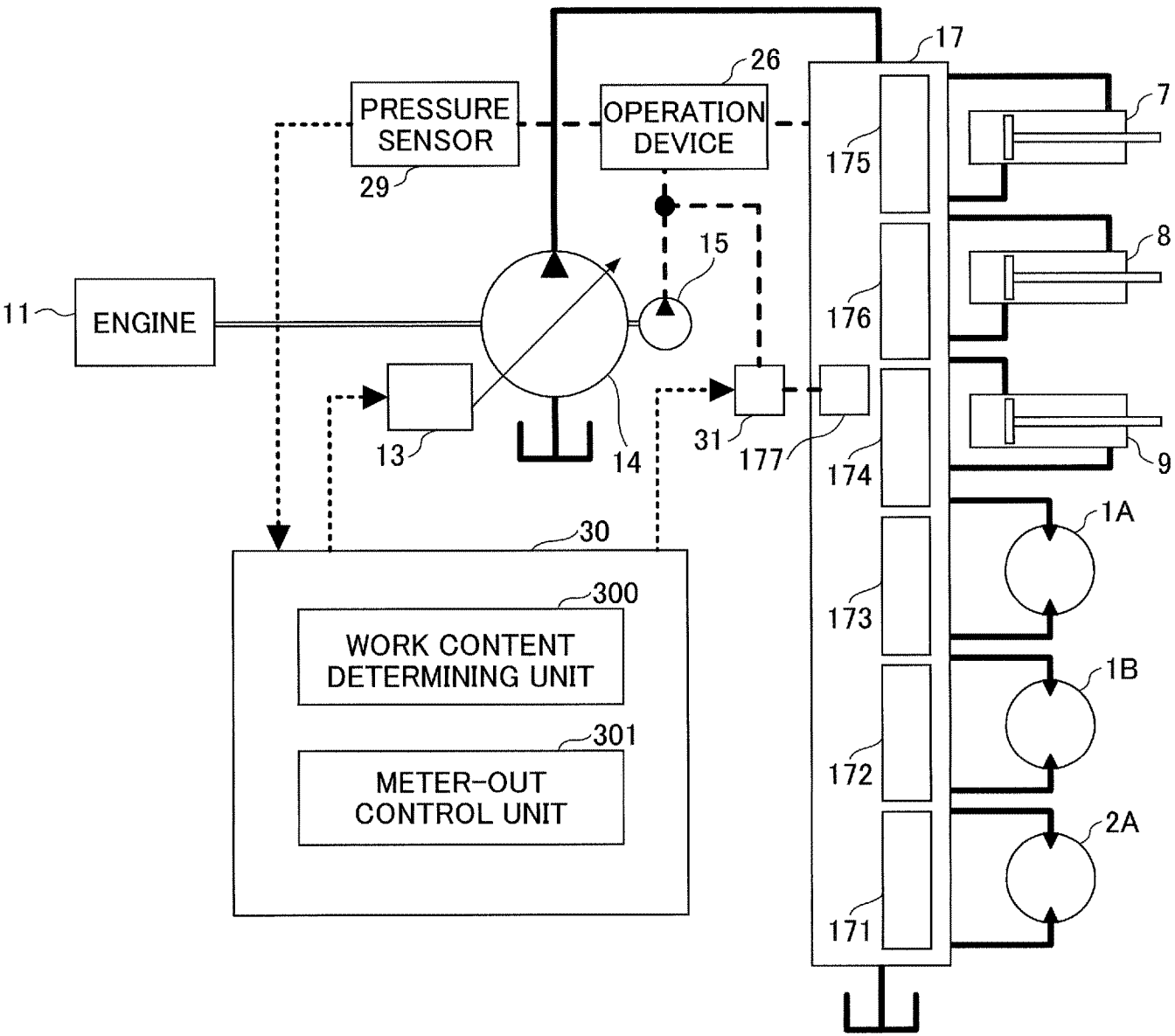
FIG. 2 is a block diagram illustrating a configuration example of a drive system of the excavator of FIG. 1.

FIG. 2 is a block diagram illustrating a configuration example of a driving system of the excavator of FIG. 1, in which a mechanical power transmission line, a hydraulic oil line, a pilot line, and an electric control line are indicated by a double line, a bold solid line, a broken line, and a dotted line, respectively.

The driving system of the excavator mainly includes the engine 11, a regulator 13, a main pump 14, a pilot pump 15, a control valve unit 17, an operation device 26, a pressure sensor 29, a controller 30, and a pressure control valve 31.

The engine 11 is a driving source of the excavator. In the present embodiment, the engine 11 is, for example, a diesel engine that is an internal combustion engine operating to maintain a predetermined rotational speed. An output shaft of the engine 11 is connected to input shafts of the main pump 14 and the pilot pump 15.

The main pump 14 supplies hydraulic oil to the control valve unit 17 via a hydraulic oil line. The main pump 14 is, for example, a swash plate type variable displacement hydraulic pump.

The regulator 13 controls the discharge amount of the main pump 14. In the present embodiment, the regulator 13 controls the discharge amount of the main pump 14, for example, by adjusting the swash plate tilt angle of the main pump 14 according to the discharge pressure of the main pump 14 and control signals from the controller 30, etc.

The pilot pump 15 supplies hydraulic oil to various hydraulic control devices including the operation device 26 and the pressure control valve 31, via the pilot line. The pilot pump 15 is, for example, a fixed displacement type hydraulic pump.

The control valve unit 17 is a hydraulic control device for controlling the hydraulic system in the excavator. Specifically, the control valve unit 17 includes control valves 171 to 176 as first control valves (first spool valves) and a control valve 177 as a second control valve (second spool valves) for controlling the flow of hydraulic oil discharged by the main pump 14. The control valve unit 17 selectively supplies the hydraulic oil discharged by the main pump 14 to one or more hydraulic actuators through the control valves 171 to 176. The control valves 171 to 176 control the flow rate of the hydraulic oil flowing from the main pump 14 to the hydraulic actuator and the flow rate of the hydraulic oil flowing from the hydraulic actuator to the hydraulic oil tank. The hydraulic actuator includes the boom cylinder 7, the arm cylinder 8, the bucket cylinder 9, a left side traveling hydraulic motor 1A, a right side traveling hydraulic motor 1B, and a turning hydraulic motor 2A. Through the control valve 177, the control valve unit 17 selectively causes the hydraulic oil, which is flowing out from the hydraulic actuator, to flow to the hydraulic oil tank. The control valve 177 controls the flow rate of the hydraulic oil flowing from the hydraulic actuator to the hydraulic oil tank.

The operation device 26 is a device used by the operator for operating the hydraulic actuator. In the present embodiment, the operation device 26 supplies the hydraulic oil discharged by the pilot pump 15 into the pilot port of the control valve corresponding to each of the hydraulic actuators, via the pilot line. The pressure (pilot pressure) of the hydraulic oil supplied to each of the pilot ports is pressure corresponding to the operation direction and the operation amount of a lever or a pedal (not illustrated) of the operation device 26 corresponding to each of the hydraulic actuators.

The pressure sensor 29 detects the operation content of the operator using the operation device 26. The pressure sensor 29 detects, for example, in the form of pressure, the operation direction and the operation amount of a lever or a pedal of the operation device 26 corresponding to each of the hydraulic actuators, and outputs the detected value to the controller 30. The operation content of the operation device 26 may be detected using a sensor other than the pressure sensor.

The controller 30 is a control device for controlling the excavator. In the present embodiment, the controller 30 is formed of a computer including, for example, a CPU, a RAM, and a ROM, etc. The controller 30 reads programs respectively corresponding to a work content determining unit 300 and a meter-out control unit 301 from the ROM, loads the programs into the RAM, and causes the CPU to execute processes corresponding to the programs.

Specifically, the controller 30 executes processes by the work content determining unit 300 and the meter-out control unit 301 based on outputs from various sensors. Subsequently, the controller 30 appropriately outputs control signals corresponding to the processing results of the work content determining unit 300 and the meter-out control unit 301, to the regulator 13 and the pressure control valve 31, etc.

For example, the work content determining unit 300 determines whether the closing motion of the arm 5 is an operation for high load work such as excavation work, or an operation for low load work such as leveling work. In the present embodiment, when the detection value of the arm bottom pressure sensor, which detects the pressure of the bottom side oil chamber of the arm cylinder 8, is greater than or equal to a predetermined value, the work content determining unit 300 determines that the operation is for high load work. Then, when the work content determining unit 300 determines that the work is high load work, the meter-out control unit 301 outputs a control instruction to the pressure control valve 31.

The pressure control valve 31 operates according to a control instruction output from the controller 30. In the present embodiment, the pressure control valve 31 is a solenoid valve that adjusts the control pressure introduced from the pilot pump 15 into the pilot port of the control valve 177 in the control valve unit 17 according to a current instruction output from the controller 30. The controller 30 increases the opening area of the flow path associated with the control valve 177 by operating the control valve 177 installed in a pipeline connecting the rod side oil chamber of the arm cylinder 8 and the hydraulic oil tank, for example. With this configuration, the controller 30 can reduce the pressure loss caused by the hydraulic oil flowing from the rod side oil chamber of the arm cylinder 8 to the hydraulic oil tank, when closing the arm 5 for high load work.

The work content determining unit 300 may determine whether the operation of lowering the boom 4 is an operation for high load work or an operation for low load work. In this case, when the detection value of the boom rod pressure sensor that detects the pressure in the rod side oil chamber of the boom cylinder 7, is greater than or equal to a predetermined value, the work content determining unit 300 determines that the operation is for high load work. Then, when the work content determining unit 300 determines that the operation is for high load work, the meter-out control unit 301 outputs a control instruction to the pressure control valve 31. The pressure control valve 31 operates the control valve 177 installed in a pipeline connecting the bottom side oil chamber of the boom cylinder 7 and the hydraulic oil tank to increase the opening area of the flow path associated with the control valve 177. With this configuration, the controller 30 can reduce the pressure loss caused by the hydraulic oil flowing from the bottom side oil chamber of the boom cylinder 7 to the hydraulic oil tank when lowering the boom 4 for high load work.

The work content determining unit 300 may determine whether regeneration is being performed at the time of lowering the boom. The regeneration at the time of boom lowering is, for example, the control that is implemented to open the arm 5 by causing the hydraulic oil flowing out from the bottom side oil chamber of the boom cylinder 7 to flow into the rod side oil chamber of the arm cylinder 8. Based on the output of the pressure sensor 29, for example, the work content determining unit 300 determines whether regeneration is being performed at the time of boom lowering. Then, when the work content determining unit 300 determines that regeneration is being performed at the time of boom lowering, the meter-out control unit 301 reduces the opening area of the flow path associated with the control valve installed in a pipeline connecting the bottom side oil chamber of the boom cylinder 7 and the hydraulic oil tank. For example, the meter-out control unit 301 blocks the flow of hydraulic oil from the bottom side oil chamber of the boom cylinder 7 to the first control valve (control valve 175) by any means. Then, the meter-out control unit 301 outputs a control instruction to the pressure control valve 31 to adjust the opening area of the flow path associated with a second control valve (control valve 177) installed in the pipeline connecting the bottom side oil chamber of the boom cylinder 7 and the hydraulic oil tank. Typically, the opening area of the flow path associated with the second control valve is adjusted so as to be smaller than the opening area of the flow path associated with the first control valve, when it is determined that regeneration is not being performed at the time of boom lowering. With this configuration, the controller 30 can increase the amount (regeneration amount) of hydraulic oil flowing from the bottom side oil chamber of the boom cylinder 7 to the rod side oil chamber of the arm cylinder 8.

Figure 3:
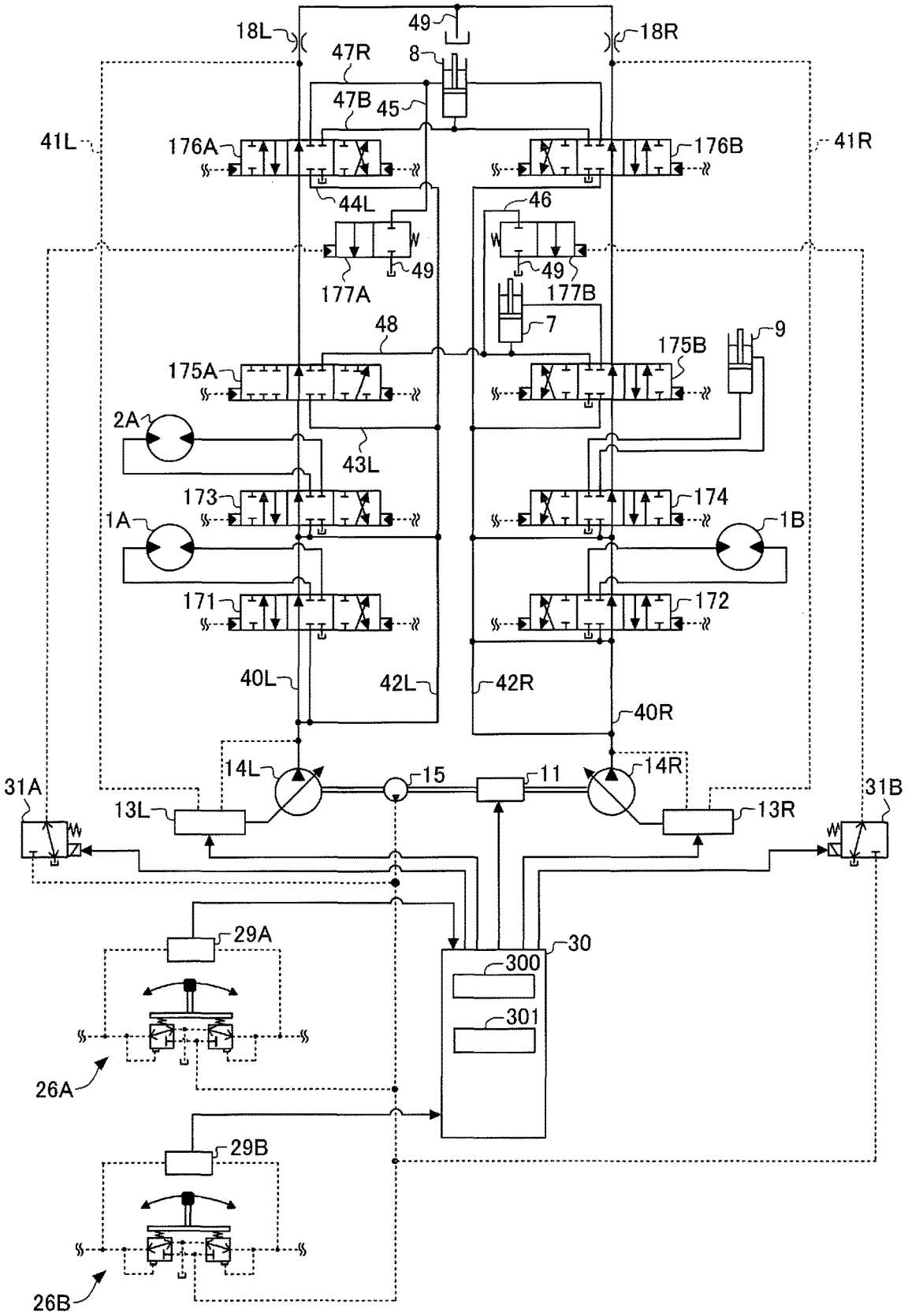
FIG. 3 is a schematic view illustrating a configuration example of a hydraulic system installed in the excavator of FIG. 1.

Next, with reference to FIG. 3, details of the hydraulic system installed in the excavator will be described. FIG. 3 is a schematic diagram illustrating a configuration example of a hydraulic system installed in the excavator of FIG. 1. In FIG. 3, similar to FIG. 2, the mechanical power transmission line, the hydraulic oil line, the pilot line, and the electric control line are indicated by a double line, a bold solid line, a broken line, and a dotted line, respectively.

In FIG. 3, the hydraulic system circulates hydraulic oil from the main pumps 14L, 14R driven by the engine 11, through center bypass pipelines 40L, 40R and parallel pipelines 42L, 42R, to the hydraulic oil tank. The main pumps 14L, 14R correspond to the main pump 14 in FIG. 2.

The center bypass pipeline 40L is a hydraulic oil line passing through the control valves 171, 173, 175A, and 176A disposed in the control valve unit 17. The center bypass pipeline 40R is a hydraulic oil line passing through the control valves 172, 174, 175B, and 176B disposed in the control valve unit 17.

The control valve 171 is a spool valve for switching the flow of the hydraulic oil, in order to supply the hydraulic oil discharged by the main pump 14L to the left side traveling hydraulic motor 1A, and also to discharge the hydraulic oil discharged by the left side traveling hydraulic motor 1A to the hydraulic oil tank.

The control valve 172 is a spool valve for switching the flow of the hydraulic oil, in order to supply the hydraulic oil discharged by the main pump 14R to the right side traveling hydraulic motor 1B, and also to discharge the hydraulic oil discharged by the right side traveling hydraulic motor 1B to the hydraulic oil tank.

The control valve 173 is a spool valve for switching the flow of the hydraulic oil, in order to supply the hydraulic oil discharged by the main pump 14L to the turning hydraulic motor 2A, and to discharge the hydraulic oil discharged by the turning hydraulic motor 2A to the hydraulic oil tank.

The control valve 174 is a spool valve for supplying the hydraulic oil discharged by the main pump 14R to the bucket cylinder 9 and to discharge the hydraulic oil in the bucket cylinder 9 to the hydraulic oil tank.

The control valves 175A, 175B are spool valves that are boom-use first control valves for switching the flow of the hydraulic oil, in order to supply the hydraulic oil discharged by the main pumps 14L, 14R to the boom cylinder 7, and to discharge the hydraulic oil in the boom cylinder 7 to the hydraulic oil tank. In the present embodiment, the control valve 175A operates only when the boom 4 is raised, and does not operate when the boom 4 is lowered.

The control valves 176A, 176B are spool valves that are arm-use first control valves for switching the flow of the hydraulic oil, in order to supply the hydraulic oil discharged by the main pumps 14L, 14R to the arm cylinder 8, and to discharge the hydraulic oil in the arm cylinder 8 to the hydraulic oil tank.

The control valve 177A is a spool valve that is an arm-use second control valve that controls the flow rate of the hydraulic oil flowing out from the rod side oil chamber of the arm cylinder 8 to the hydraulic oil tank. The control valve 177B is a spool valve that is a boom-use second control valve that controls the flow rate of hydraulic oil flowing out from the bottom side oil chamber of the boom cylinder 7 to the hydraulic oil tank. The control valves 177A, 177B correspond to the control valve 177 in FIG. 2

The control valves 177A, 177B have a first valve position with a minimum opening area (opening degree 0%) and a second valve position with a maximum opening area (opening degree 100%). The control valves 177A, 177B are movable in a stepless manner between the first valve position and the second valve position.

The parallel pipeline 42L is a hydraulic oil line parallel to the center bypass pipeline 40L. The parallel pipeline 42L can supply hydraulic oil to a control valve on a further downstream side, when the flow of the hydraulic oil passing through the center bypass pipeline 40L is limited or blocked by any one of the control valves 171, 173, and 175A. The parallel pipeline 42R is a hydraulic oil line parallel to the center bypass pipeline 40R. The parallel pipeline 42R can supply hydraulic oil to a control valve on a further downstream side, when the flow of hydraulic oil passing through the center bypass pipeline 40R is limited or blocked by any one of the control valves 172, 174, and 175B.

The regulators 13L, 13R control the discharge amounts of the main pumps 14L, 14R, for example, by adjusting the swash plate tilt angles of the main pumps 14L, 14R according to the discharge pressure of the main pumps 14L, 14R. The regulators 13L, 13R correspond to the regulator 13 in FIG. 2. Specifically, for example, when the discharge pressure of the main pumps 14L, 14R become greater than or equal to a predetermined value, the regulators 13L, 13R adjust the swash plate tilt angle of the main pumps 14L, 14R to decrease the discharge amount. This is done in order to prevent the absorption horsepower of the main pump 14, represented by the product of the discharge pressure and the discharge amount, from exceeding the output horsepower of the engine 11.

An arm operation lever 26A is an example of the operation device 26, and is used for operating the arm 5. The arm operation lever 26A introduces the control pressure corresponding to the lever operation amount into the pilot ports of the control valves 176A, 176B, by using the hydraulic oil discharged by the pilot pump 15. Specifically, when the arm operation lever 26A is operated in the arm closing direction, the hydraulic oil is introduced into the right pilot port of the control valve 176A, and the hydraulic oil is introduced into the left pilot port of the control valve 176B. When the arm operation lever 26A is operated in the arm opening direction, the hydraulic oil is introduced into the left pilot port of the control valve 176A, and the hydraulic oil is introduced into the right pilot port of the control valve 176B.

A boom operation lever 26B is an example of the operation device 26 and is used for operating the boom 4. The boom operation lever 26B introduces the control pressure corresponding to the lever operation amount into the pilot ports of the control valves 175A, 175B, by using the hydraulic oil discharged by the pilot pump 15. Specifically, when the boom operation lever 26B is operated in the boom raising direction, the hydraulic oil is introduced into the right pilot port of the control valve 175A, and the hydraulic oil is introduced into the left pilot port of the control valve 175B. On the other hand, when the boom operation lever 26B is operated in the boom lowering direction, hydraulic oil is introduced only into the right pilot port of the control valve 175B, without introducing hydraulic oil into the left pilot port of the control valve 175A.

The pressure sensors 29A, 29B are examples of the pressure sensor 29, and detect, in the form of pressure, the operation contents by the operator with respect to the arm operation lever 26A and the boom operation lever 26B, and output the detected values to the controller 30. The operation content is, for example, a lever operation direction and a lever operation amount (lever operation angle), etc.

Left and right traveling levers (or pedals), a bucket operation lever, and a turning operation lever (none are illustrated), are operation devices that respectively operate the traveling of the lower travelling body 1, the opening and closing of the bucket 6, and the turning of the upper turning body 3. Similar to the case of the arm operation lever 26A, these operation devices introduce the control pressure corresponding to the lever operation amount (or the pedal operation amount) to the left or right pilot port of the control valve corresponding to each of the hydraulic actuators, by using the hydraulic oil discharged by the pilot pump 15. Similar to the case of the pressure sensor 29A, the operation contents by the operator for each of these operation devices are detected in the form of pressure by the corresponding pressure sensors, and the detection values are output to the controller 30.

The controller 30 receives the output of the pressure sensor 29A, etc., outputs a control signal to the regulators 13L, 13R as necessary, and changes the discharge amount of the main pumps 14L, 14R.

The pressure control valves 31A, 31B adjust the control pressure introduced from the pilot pump 15 into the pilot ports of the control valves 177A, 177B, according to a current instruction output from the controller 30. The pressure control valves 31A, 31B correspond to the pressure control valve 31 in FIG. 2.

The pressure control valve 31A is capable of adjusting the control pressure so that the control valve 177A can be stopped at any position between the first valve position and the second valve position. The pressure control valve 31B is capable of adjusting the control pressure so that the control valve 177B can be stopped at any position between the first valve position and the second valve position.

Here, negative control adopted in the hydraulic system of FIG. 3 will be described.

The center bypass pipelines 40L, 40R are provided with negative control diaphragms 18L, 18R between the respective control valves 176A, 176B located at the most downstream side and the hydraulic oil tank. The flow of the hydraulic oil discharged by the main pumps 14L, 14R is limited by the negative control diaphragms 18L, 18R. Then, the negative control diaphragms 18L, 18R generate control pressure (hereinafter referred to as "negative control pressure") for controlling the regulators 13L, 13R.

Negative control pressure pipelines 41L, 41R indicated by broken lines are pilot lines for transmitting the negative control pressure generated upstream of the negative control diaphragms 18L, 18R to the regulators 13L, 13R.

The regulators 13L, 13R control the discharge amounts of the main pumps 14L, 14R by adjusting the swash plate tilt angle of the main pumps 14L, 14R according to the negative control pressure. In the present embodiment, the regulators 13L, 13R decrease the discharge amounts of the main pumps 14L, 14R as the introduced negative control pressure increases, and increase the discharge amounts of the main pumps 14L, 14R as the introduced negative control pressure decreases.

Specifically, as illustrated in FIG. 3, when none of the hydraulic actuators in the excavator are operated (hereinafter referred to as a "standby mode"), the hydraulic oil discharged by the main pumps 14L, 14R passes through the center bypass pipelines 40L, 40R and reaches the negative control diaphragms 18L, 18R. Then, the flow of the hydraulic oil discharged by the main pumps 14L, 14R increases the negative control pressure generated upstream of the negative control diaphragms 18L, 18R. As a result, the regulators 13L, 13R decrease the discharge amounts of the main pumps 14L, 14R to the allowable minimum discharge amount, and suppress the pressure loss (pumping loss) when the discharged hydraulic oil passes through the center bypass pipelines 40L, 40R.

On the other hand, when any of the hydraulic actuators is operated, the hydraulic oil discharged by the main pumps 14L, 14R flows into the operated hydraulic actuator via the control valve corresponding to the operated hydraulic actuator. Then, the flow of the hydraulic oil discharged by the main pumps 14L, 14R reduces or eliminates the amount reaching the negative control diaphragms 18L, 18R, and lowers the negative control pressure generated upstream of the negative control diaphragms 18L, 18R. As a result, the regulators 13L, 13R receiving the reduced negative control pressure increase the discharge amounts of the main pumps 14L, 14R, and circulate a sufficient amount of hydraulic oil to the operated hydraulic actuator, to reliably drive the operated hydraulic actuator.

With the above configuration, in the hydraulic system of FIG. 3, it is possible to suppress wasteful energy consumption in the main pumps 14L, 14R in the standby mode. Wasteful energy consumption includes pumping loss in the center bypass pipelines 40L, 40R caused by the hydraulic oil discharged by the main pumps 14L, 14R.

In the hydraulic system of FIG. 3, when operating the hydraulic actuator, it is possible to reliably supply a necessary and sufficient amount of hydraulic oil from the main pumps 14L, 14R to the operated hydraulic actuator.

Figure 4:
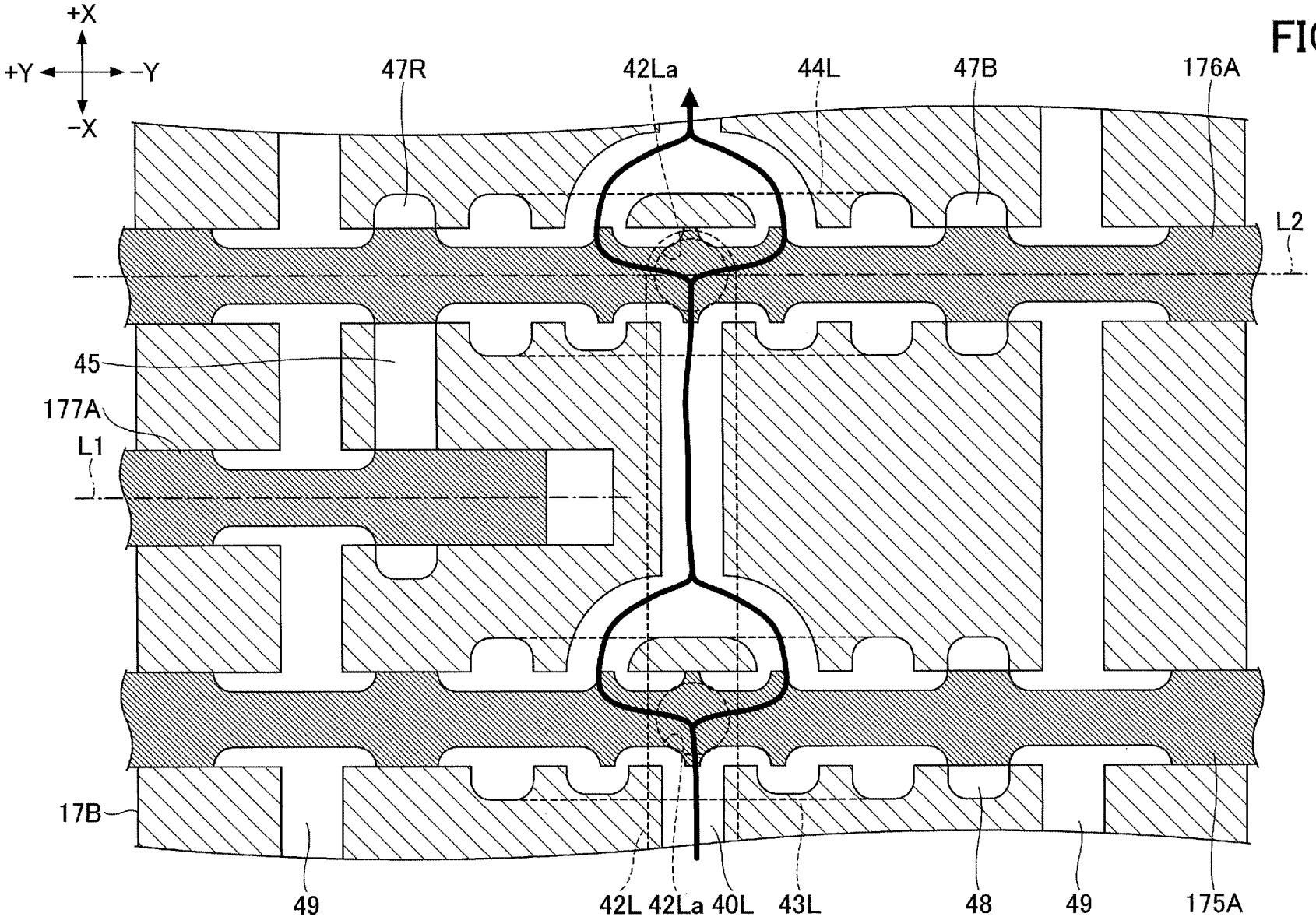
FIG. 4 is a partial cross-sectional view of a control valve.
Figure 5:
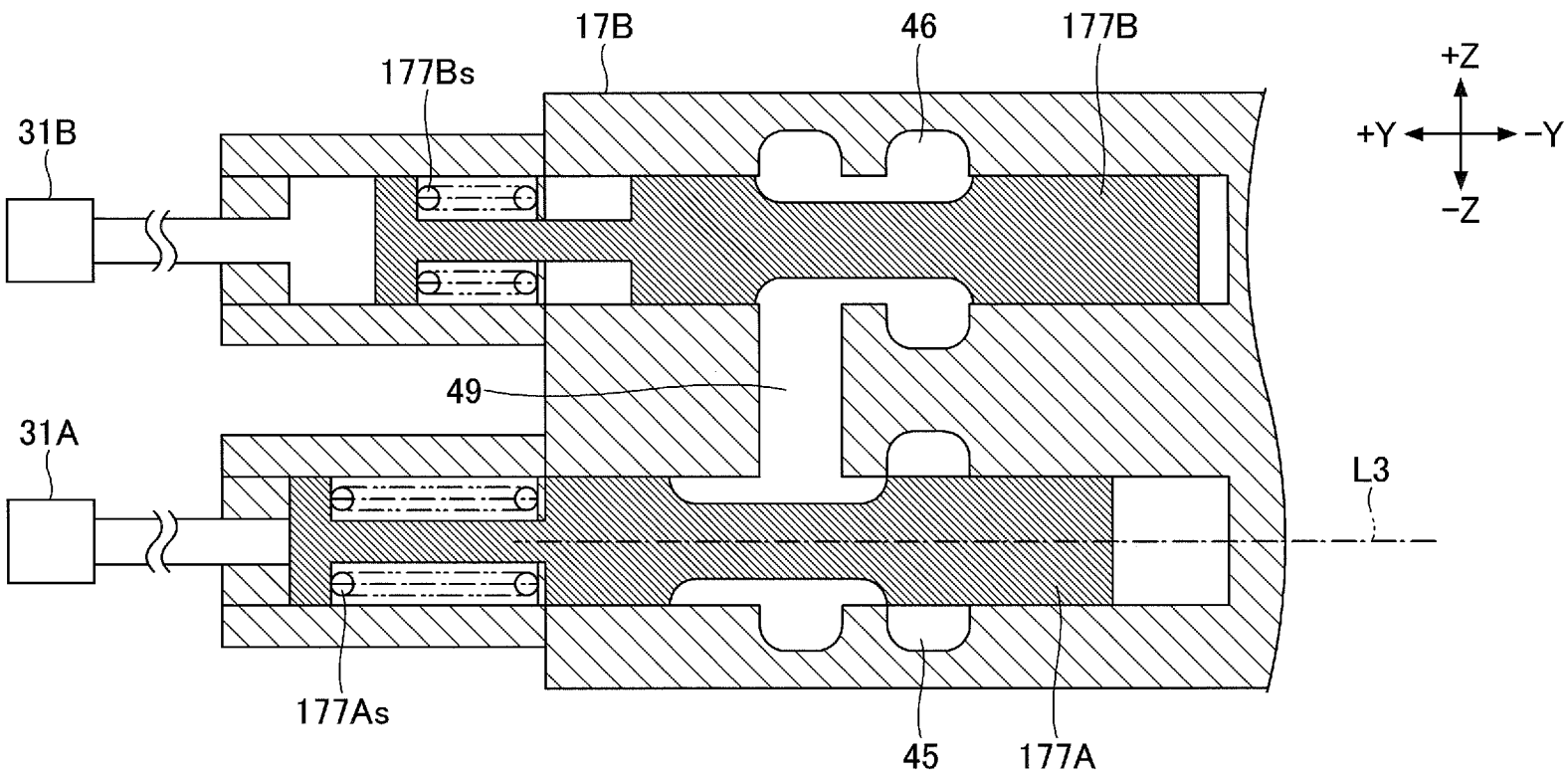
FIG. 5 is a partial cross-sectional view of a second control valve.
Figure 6:
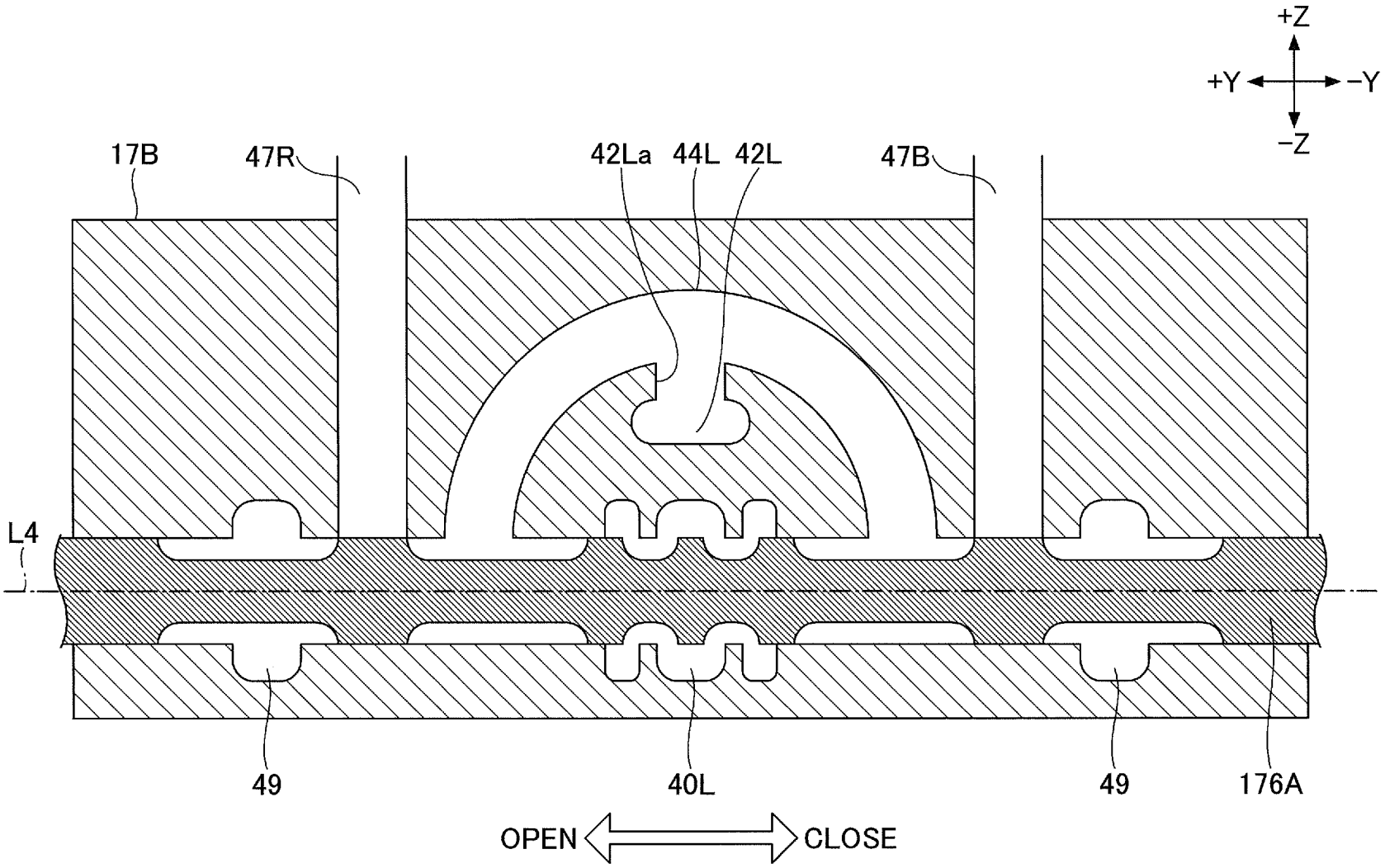
FIG. 6 is a partial cross-sectional view of an arm-use first control valve.

Next, with reference to FIGS. 4 to 6, the configuration of the control valve 177A and the control valve 177B (invisible in FIG. 4) will be described. FIG. 4 is a partial cross-sectional of the control valve unit 17. FIG. 5 is a partial cross-sectional view of the control valve 177A and the control valve 177B as viewed from the −X side of a plane including a line segment L1 indicated by a one-dot chain line in FIG. 4. FIG. 6 is a partial cross-sectional view of the control valve 176A as viewed from the −X side of a plane including a line segment L2 indicated by a two-dot chain line in FIG. 4. FIG. 4 corresponds to a partial cross-sectional view as viewed from the +Z side of a plane including a line segment L3 indicated by a one-dot chain line in FIG. 5 and a line segment L4 indicated by a one-dot chain line in FIG. 6. The bold solid arrows in FIG. 4 indicate the flow of hydraulic oil in the center bypass pipeline 40L.

In the present embodiment, the control valve 175A, the control valve 176A, the control valve 177A, and the control valve 177B are formed in a valve block 17B of the control valve unit 17. The control valve 177A and the control valve 177B are disposed between the control valve 175A and the control valve 176A. That is, the control valve 177A and the control valve 177B are disposed on the +X side of the control valve 175A and on the −X side of the control valve 176A.

As illustrated in FIG. 4, the center bypass pipeline 40L branches into two right and left pipelines on the downstream side of the spool of the control valve 175A, and then joins together as one pipeline. Then, the center bypass pipeline 40L leads to the next control valve 176A in the state of one pipeline. When the arm operation lever 26A and the boom operation lever 26B are both in a neutral state, the hydraulic oil flowing through the center bypass pipeline 40L crosses the spool of each control valve and flows to the downstream side of the spool of each control valve, as indicated by the thick solid lines in FIG. 4.

As illustrated in FIG. 5, the control valve 177B is disposed on the +Z side of the control valve 177A. FIG. 5 illustrates that the control valve 177A is at the first valve position with an opening degree of 0%, and the control valve 177B is at the second valve position with an opening degree of 100%. The control valve 177A blocks the communication between a meter-out pipeline 45 and a return oil pipeline 49 at the first valve position. Then, when a spring 177As contracts in accordance with the rise in the control pressure generated by the pressure control valve 31A, the control valve 177A moves to the −Y side to increase the opening area of the flow path connecting the meter-out pipeline 45 and the return oil pipeline 49. The meter-out pipeline 45 is a pipeline connecting the rod-side oil chamber of the arm cylinder 8 and the control valve 177A. Similarly, the control valve 177B blocks the communication between a meter-out pipeline 46 and the return oil pipeline 49 at the first valve position. When a spring 177Bs contracts according to the rise of the control pressure generated by the pressure control valve 31B, the control valve 177B moves to the −Y side to increase the opening area of the flow path connecting the meter-out pipeline 46 and the return oil pipeline 49. The meter-out pipeline 46 is a pipeline connecting the bottom-side oil chamber of the boom cylinder 7 and the control valve 177B.

As indicated by the bidirectional arrow in FIG. 6, the spool of the control valve 176A moves to the −Y side when the arm operation lever 26A is operated in the closing direction, and moves to the +Y side when the arm operation lever 26A is operated in the opening direction. When the arm operation lever 26A is operated, the hydraulic oil in the center bypass pipeline 40L is blocked by the spool of the control valve 176A, and does not flow to the downstream side thereof. The control valve 176A is structured such that the parallel pipeline 42L can selectively communicate with either an arm bottom pipeline 47B or an arm rod pipeline 47R via the bridge pipeline 44L. Specifically, when the spool moves in the −Y direction, the center bypass pipeline 40L is blocked. Then, the bridge pipeline 44L and the arm bottom pipeline 47B communicate with each other, and the arm rod pipeline 47R and the return oil pipeline 49 communicate with each other, by grooves formed in the spool. Then, the hydraulic oil flowing through the parallel pipeline 42L flows into the bottom side oil chamber of the arm cylinder 8 through a connection pipeline 42La, the bridge pipeline 44L, and the arm bottom pipeline 47B. Furthermore, the hydraulic oil flowing out from the rod side oil chamber of the arm cylinder 8 is discharged to the hydraulic oil tank through the arm rod pipeline 47R and the return oil pipeline 49. As a result, the arm cylinder 8 expands and the arm 5 is closed. Alternatively, when the spool moves in the +Y direction, the center bypass pipeline 40L is blocked. Then, the bridge pipeline 44L and the arm rod pipeline 47R communicate with each other, and the arm bottom pipeline 47B and the return oil pipeline 49 communicate with each other, by grooves formed in the spool. The hydraulic oil flowing through the parallel pipeline 42L flows into the rod side oil chamber of the arm cylinder 8 through the connection pipeline 42La, the bridge pipeline 44L, and the arm rod pipeline 47R. The hydraulic oil flowing out from the bottom side oil chamber of the arm cylinder 8 is discharged to the hydraulic oil tank through the arm bottom pipeline 47B and the return oil pipeline 49. As a result, the arm cylinder 8 is contracted and the arm 5 is opened.

Figure 7:
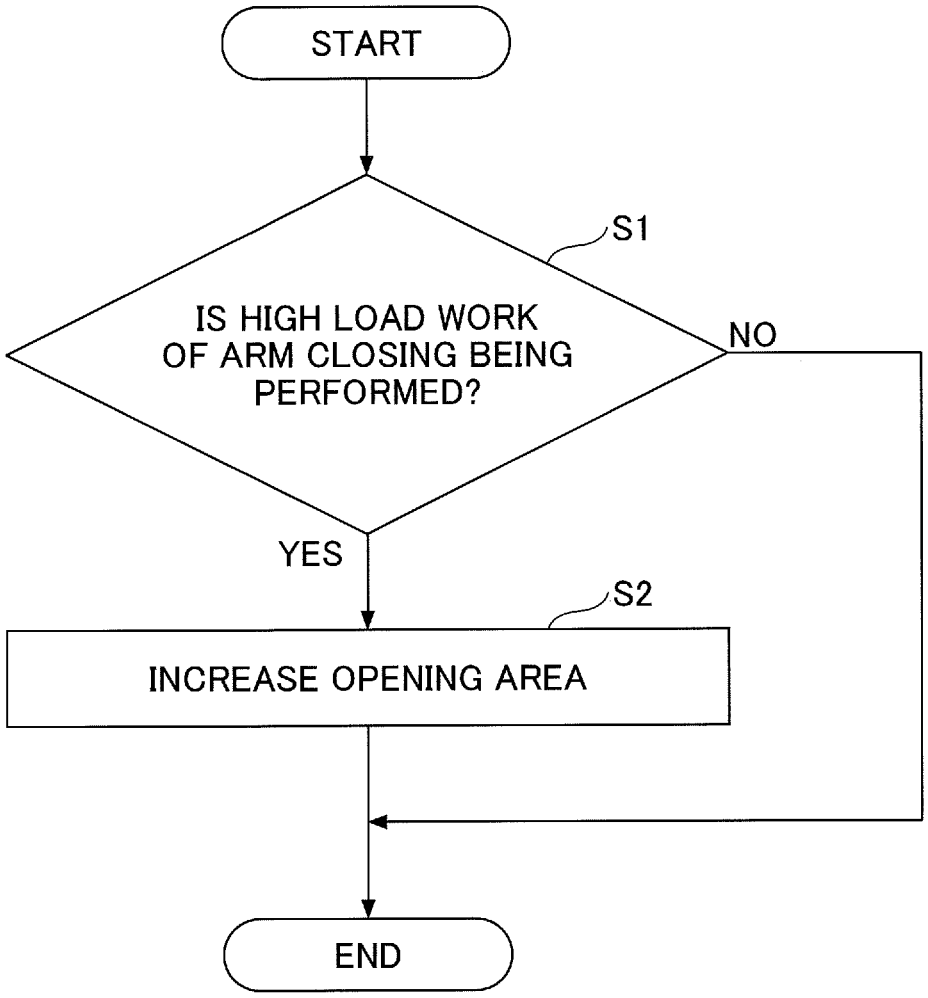
FIG. 7 is a flowchart illustrating a flow of an example of a meter-out process.
Figure 8:
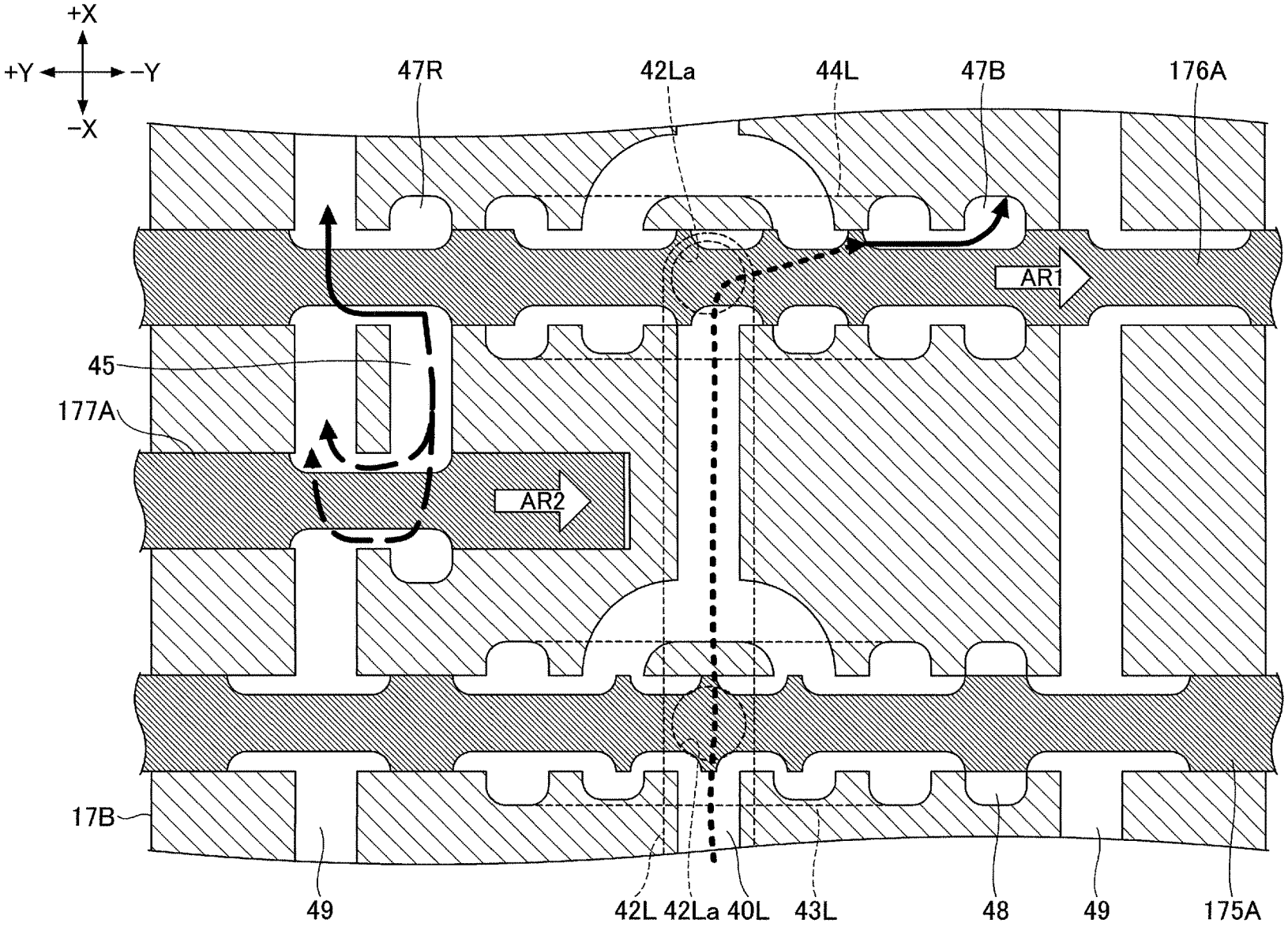
FIG. 8 is a partial cross-sectional view of a control valve illustrating a state when high load work is being performed.
Figure 9:
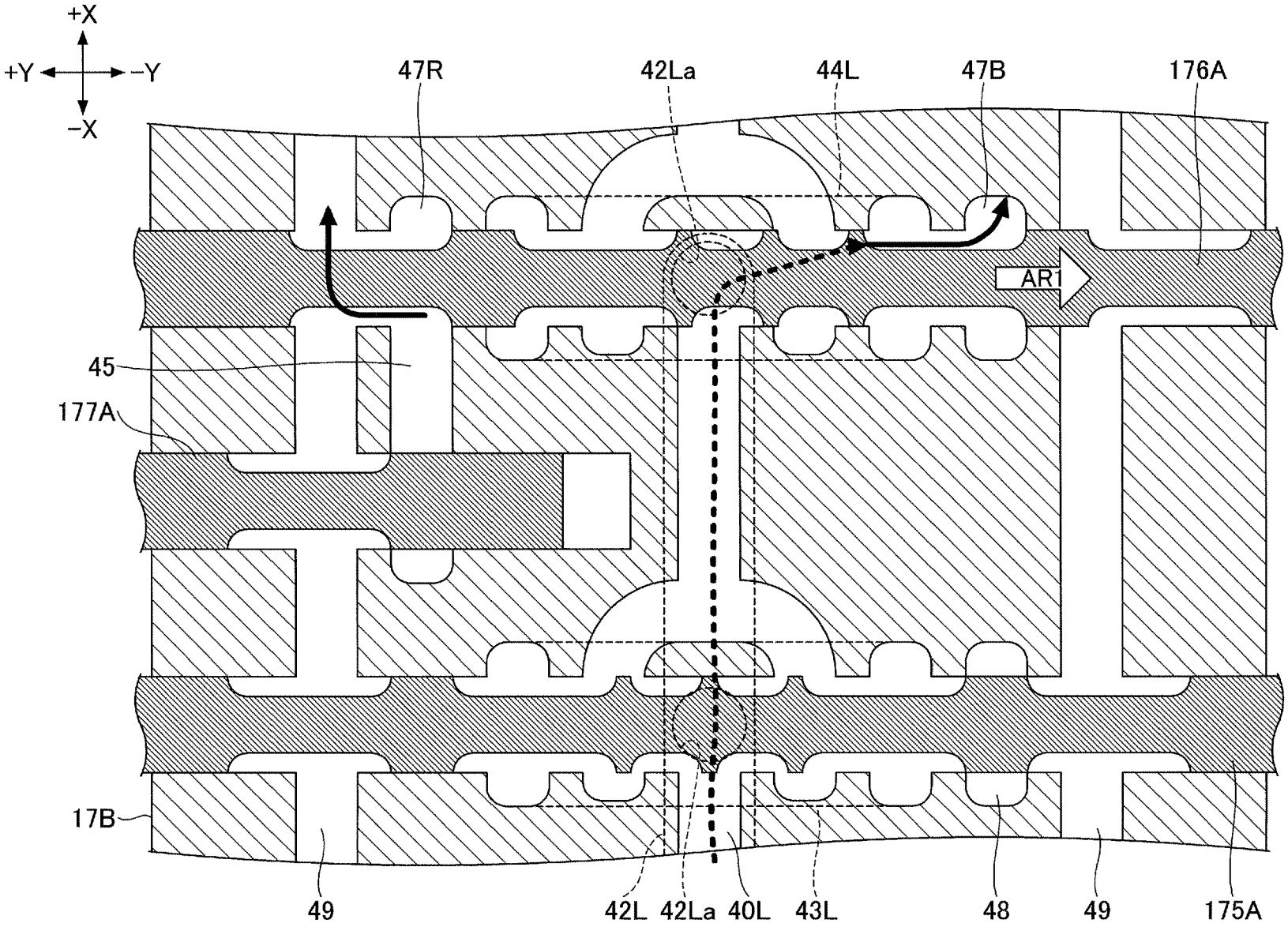
FIG. 9 is a partial cross-sectional view of a control valve illustrating a state in which low load work is being performed.

Next, with reference to FIGS. 7 to 9, a process (hereinafter referred to as "meter-out process") in which the controller 30 controls the opening and the closing of the control valve 177A will be described. FIG. 7 is a flowchart illustrating the flow of a meter-out process. During the arm closing operation, the controller 30 repeats this meter-out process in a predetermined control cycle. FIGS. 8 and 9 correspond to FIG. 4 and illustrate the state of the control valve unit 17 when the arm operation lever 26A is operated. FIG. 8 illustrates a state when high load work is performed, and FIG. 9 illustrates a state when low load work is performed.

When the arm operation lever 26A is operated in the arm closing direction, the control valve 176A moves in the −Y direction as indicated by the arrow AR1 in FIGS. 8 and 9 to block the center bypass pipeline 40L. Furthermore, the bridge pipeline 44L and the arm bottom pipeline 47B communicate with each other, and the arm rod pipeline 47R and the return oil pipeline 49 communicate with each other, by grooves formed in the spool of the control valve 176A. Then, the hydraulic oil flowing through the parallel pipeline 42L flows into the bottom side oil chamber of the arm cylinder 8 through the connection pipeline 42La, the bridge pipeline 44L, and the arm bottom pipeline 47B. Furthermore, the hydraulic oil flowing out from the rod side oil chamber of the arm cylinder 8 is discharged to the hydraulic oil tank through the arm rod pipeline 47R and the return oil pipeline 49. As a result, the arm cylinder 8 expands and the arm 5 is closed. In FIGS. 8 and 9, the hydraulic oil flowing through the parallel pipeline 42L and the bridge pipeline 44L is indicated by thick dotted arrows. Also, the hydraulic oil flowing from the bridge pipeline 44L to the arm bottom pipeline 47B and the hydraulic oil flowing from the arm rod pipeline 47R to the return oil pipeline 49 are indicated by thick solid arrows.

In the meter-out process, as illustrated in FIG. 7, the work content determining unit 300 of the controller 30 determines whether high load work by closing the arm is being performed (step S1). For example, when the detection value of the arm bottom pressure sensor is greater than or equal to a predetermined value, it is determined that high load work by arm closing is being performed.

When the work content determining unit 300 determines that the high load work by arm closing is performed (YES in step S1), the meter-out control unit 301 of the controller 30 increases the opening area of the flow path connecting the meter-out pipeline 45 and the return oil pipeline 49 (step S2). In the present embodiment, the meter-out control unit 301 raises the control pressure generated by the pressure control valve 31A by outputting a current instruction to the pressure control valve 31A. As indicated by an arrow AR2 in FIG. 8, the control valve 177A moves to the −Y side in accordance with the rise of the control pressure and increases the opening area of the flow path connecting the meter-out pipeline 45 and the return oil pipeline 49. As a result, most of the hydraulic oil flowing out from the rod-side oil chamber of the arm cylinder 8 passes through the meter-out pipeline 45 and the return oil pipeline 49 and is discharged to the hydraulic oil tank. In FIG. 8, the hydraulic oil flowing from the arm rod pipeline 47R through the meter-out pipeline 45 to the return oil pipeline 49 is indicated by thick broken line arrows. With this configuration, the controller 30 can reduce the pressure loss that is caused when the hydraulic oil flows out from the rod-side oil chamber of the arm cylinder 8 to the hydraulic oil tank, and it is possible to prevent the hydraulic energy from being wastefully consumed in the high load work.

When the work content determining unit 300 determines that low load work of the arm closing is performed (NO in step S1), the meter-out control unit 301 does not increase the opening area of the flow path connecting the meter-out pipeline 45 and the return oil pipeline 49. The control valve 177A remains stationary as illustrated in FIG. 9 and does not allow the communication of the flow path connecting the meter-out pipeline 45 and the return oil pipeline 49. As a result, the hydraulic oil flowing out from the rod-side oil chamber of the arm cylinder 8 flows through the flow path connecting the arm rod pipeline 47R and the return oil pipeline 49, which are communicated by a groove formed in the spool of the control valve 176A, and is discharged to the hydraulic oil tank. With this configuration, the controller 30 can appropriately limit the flow rate of the hydraulic oil flowing out from the rod-side oil chamber of the arm cylinder 8 to the hydraulic oil tank, so that the movement of the arm 5 is prevented from becoming excessively fast at the time of the low load work.

In the embodiment described above, the controller 30 controls the control valve 177A to increase the opening area when it is determined that high load work of the arm closing is being performed, to reduce the pressure loss that is caused when hydraulic oil flows from the rod side oil chamber of the arm cylinder 8 to the hydraulic oil tank. This process is also executed when it is determined that high load work including boom lowering is being performed. Specifically, when the controller 30 determines that high load work including boom lowering is performed, the controller 30 controls the control valve 177B to increase the opening area, to reduce the pressure loss that is caused when hydraulic oil flows from the bottom side oil chamber of the boom cylinder 7 to the hydraulic oil tank.

Although the preferred embodiments of the present invention have been described in detail above, the present invention is not limited to the above-described embodiments, and various modifications and substitutions may be made to the above-described embodiments without departing from the scope of the present invention.

For example, in the above-described embodiment, the control valve 177 is incorporated in the valve block 17B of the control valve unit 17. Therefore, it is unnecessary to attach the control valve 177 to the outside of the valve block 17B, and it is possible to realize a low-cost and compact hydraulic system including the control valve 177. However, a configuration in which the control valve 177 is attached to the outside of the valve block 17B is not excluded. That is, the control valve 177 may be disposed outside the valve block 17B.

Furthermore, in the above-described embodiment, a configuration is adopted in which the first spool valve corresponding to each hydraulic actuator individually executes the bleed-off control; but it is also possible to adopt a configuration in which the bleed-off control for a plurality of hydraulic actuators is executed in a unified manner, by using a unified bleed off valve provided between the center bypass pipeline and the hydraulic oil tank. In this case, even when each first spool valve moves from the neutral position, the flow path area of the center bypass pipeline is prevented from decreasing, that is, each first spool valve does not block the center bypass pipeline. Even when this unified bleed-off valve is used, in the application of the present invention, a parallel pipeline is formed separately from the center bypass pipeline.

According to an embodiment of the present invention, an excavator that reduces, when necessary, the pressure loss caused when hydraulic oil is caused to flow from a hydraulic cylinder to a hydraulic oil tank, can be provided.

It should be understood that the invention is not limited to the above-described embodiment, but may be modified into various forms on the basis of the spirit of the invention. Additionally, the modifications are included in the scope of the invention.

What is claimed is:

1. An excavator comprising:
- a lower travelling body;
- an upper turning body mounted on the lower travelling body;
- an engine installed in the upper turning body;
- a hydraulic pump connected to the engine;
- a hydraulic actuator driven by hydraulic oil discharged by the hydraulic pump to move a work element;
- a control valve including
  - a first control valve configured to control, with a movement of a spool, a flow rate of the hydraulic oil flowing from the hydraulic pump to the hydraulic actuator; and
  - a second control valve configured to control a flow rate of the hydraulic oil that flows from the hydraulic actuator to a hydraulic oil tank without flowing through the spool of the first control valve; and
- a hardware processor configured to control opening and closing of the second control valve,
- wherein the first control valve and the second control valve are formed in a valve block of the control valve.

2. The excavator according to claim 1, wherein
- the first control valve includes
  - a boom-use first control valve configured to control a flow rate of the hydraulic oil flowing from the hydraulic pump to a boom cylinder, and
  - an arm-use first control valve configured to control a flow rate of the hydraulic oil flowing from the hydraulic pump to an arm cylinder, and
- the second control valve includes
  - a boom-use second control valve configured to control a flow rate of the hydraulic oil flowing from the boom cylinder to the hydraulic oil tank, and
  - an arm-use second control valve configured to control a flow rate of the hydraulic oil flowing from the arm cylinder to the hydraulic oil tank.

3. The excavator according to claim 2, wherein
- the boom-use first control valve, the boom-use second control valve, the arm-use first control valve, and the arm-use second control valve are formed in the valve block of control valves, and
- one or both of the boom-use second control valve and the arm-use second control valve are disposed between the boom-use first control valve and the arm-use first control valve.

4. The excavator according to claim 1, wherein the hardware processor is configured to determine whether excavation is being performed by the work element moved by the hydraulic actuator, and to increase an opening area of the second control valve in response to determining that the excavation is being performed.

5. The excavator according to claim 1, wherein the hardware processor is configured to determine whether regeneration, of supplying the hydraulic oil flowing out from the hydraulic actuator to another hydraulic actuator, is being performed, and to adjust an opening area of the second control valve to increase a regeneration amount, in response to determining that the regeneration is being performed.

6. The excavator as claimed in claim 1, wherein the second control valve is positioned directly downstream of the hydraulic actuator and directly upstream of the hydraulic oil tank in a flow of the hydraulic oil flowing from the hydraulic actuator to the hydraulic oil tank.

7. A control valve for an excavator, the excavator including a lower travelling body, an upper turning body mounted on the lower travelling body, an engine installed in the upper turning body, a hydraulic pump connected to the engine, and a hydraulic actuator driven by hydraulic oil discharged by the hydraulic pump to move a work element, the control valve for the excavator comprising:

a valve block;

a first spool valve configured to control, with a movement of a spool, a flow rate of the hydraulic oil flowing from the hydraulic pump to the hydraulic actuator; and a second spool valve configured to control a flow rate of the hydraulic oil that flows from the hydraulic actuator to a hydraulic oil tank without flowing through the spool of the first spool valve, wherein the first spool valve and the second spool valve are formed in the valve block of the control valve for the excavator.

8. The control valve for the excavator according to claim 7, wherein the second spool valve includes a boom-use second control valve configured to control a flow rate of the hydraulic oil flowing from a boom cylinder to the hydraulic oil tank.

9. The control valve for the excavator according to claim 8, wherein the first spool valve includes a boom-use first control valve configured to control a flow rate of the hydraulic oil flowing from the hydraulic pump to the boom cylinder, and an arm-use first control valve configured to control a flow rate of the hydraulic oil flowing from the hydraulic pump to an arm cylinder, and the boom-use second control valve is disposed between the boom-use first control valve and the arm-use first control valve.

10. The control valve for the excavator according to claim 7, wherein the second spool valve includes an arm-use second control valve configured to control a flow rate of the hydraulic oil flowing from an arm cylinder to the hydraulic oil tank.

11. The control valve for the excavator according to claim 10, wherein the first spool valve includes a boom-use first control valve configured to control a flow rate of the hydraulic oil flowing from the hydraulic pump to a boom cylinder, and an arm-use first control valve configured to control a flow rate of the hydraulic oil flowing from the hydraulic pump to the arm cylinder, and the arm-use second control valve is disposed between the boom-use first control valve and the arm-use first control valve.

* * * * *